United States Patent [19]

Pampuch

[11] 4,157,091

[45] Jun. 5, 1979

[54] RESPIRATOR

[75] Inventor: Klaus Pampuch, Berlin, Fed. Rep. of Germany

[73] Assignee: Auergesellschaft GmbH, Berlin, Fed. Rep. of Germany

[21] Appl. No.: 832,202

[22] Filed: Sep. 12, 1977

[30] Foreign Application Priority Data

Sep. 13, 1976 [DE] Fed. Rep. of Germany ..... 2641576

[51] Int. Cl.[2] ..... A62B 7/00

[52] U.S. Cl. ..... 128/142 R; 128/191 R; 128/147

[58] Field of Search ..... 128/191 R, 202, 142 R, 128/142.3, 142.6, 146.6, 147

[56] References Cited

U.S. PATENT DOCUMENTS

| | | | |
|---|---|---|---|
| 1,533,172 | 4/1925 | Drager | 128/191 R |
| 1,679,115 | 7/1928 | Drager | 128/191 R |
| 2,269,500 | 1/1942 | Wildhack | 128/191 R |
| 2,428,451 | 10/1947 | Emerson | 128/145.7 |
| 3,556,098 | 1/1971 | Kanwisher | 128/142 |
| 3,980,081 | 9/1976 | Cotabish et al. | 128/147 |

FOREIGN PATENT DOCUMENTS

| | | | |
|---|---|---|---|
| 1336301 | 7/1962 | France | 128/202 |
| 447119 | 5/1936 | United Kingdom | 128/191 R |

*Primary Examiner*—Henry J. Recla
*Attorney, Agent, or Firm*—Brown, Flick & Pedkham

[57] ABSTRACT

A respirator canister provided with openings for flow of air therethrough is filled with a chemical that removes water vapor and carbon dioxide from the air and liberates oxygen into it. A breathing tube communicates with one of the canister openings, and an expandable breathing bag or equivalent has an opening communicating with the other canister opening. A spring or the like resists expansion of the bag during exhalation through the breathing tube and canister in order to maintain the air in the respirator under positive pressure to prevent toxic air from leaking into the respirator.

2 Claims, 2 Drawing Figures

RESPIRATOR

With closed circuit breathing apparatus of the known kinds, whether of the circulatory or rhythmic type, there always is the possibility that toxic ambient air may leak into the system, due to a leak in the apparatus or to a poor seal between the breathing mask and the face of the wearer.

It is among the objects of this invention to provide breathing apparatus, in which a positive pressure is maintained to prevent inhaling of ambient air through leaks in the system.

The invention is illustrated in the accompanying drawings, in which

Figure 1:
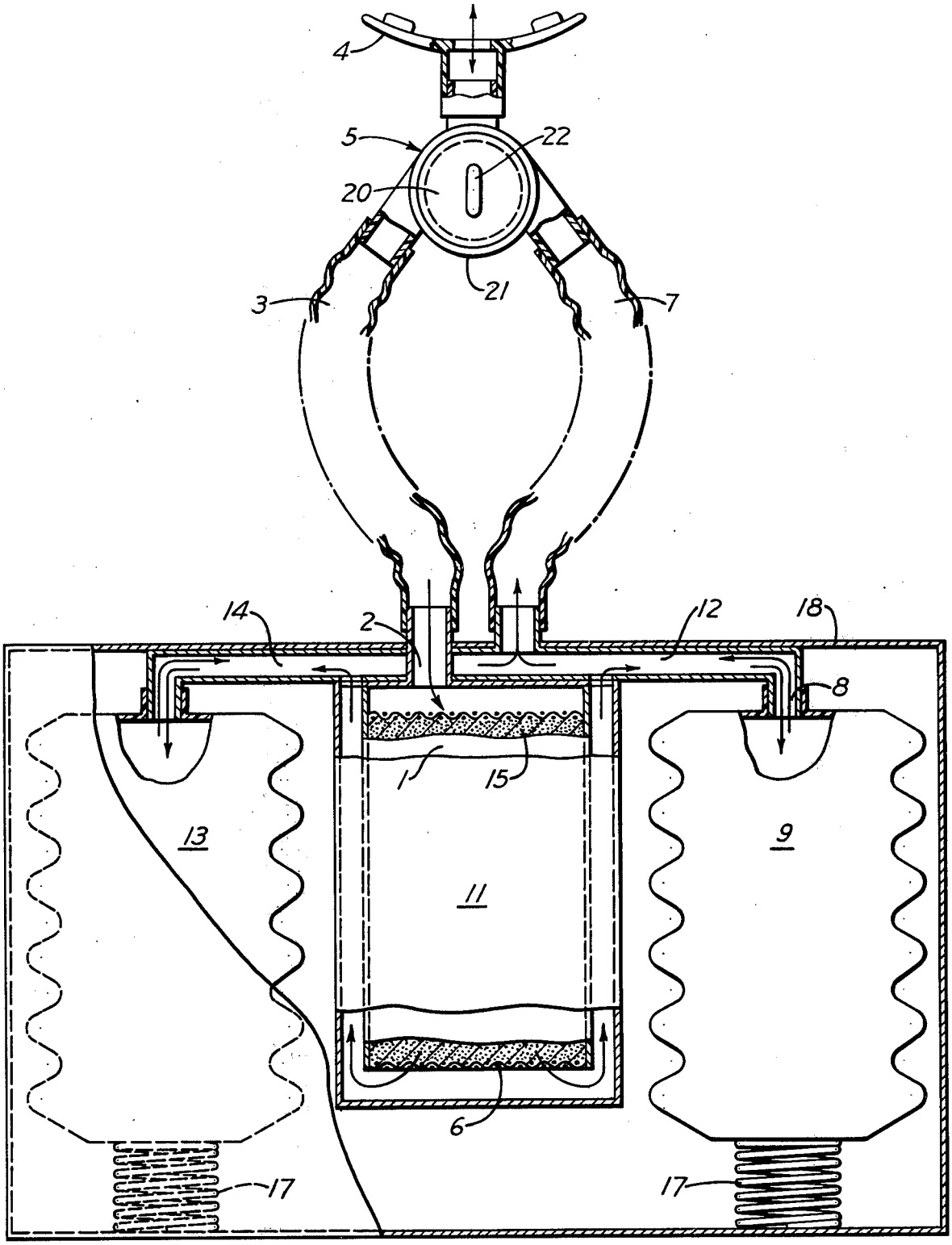
FIG. 1 is a side view of the apparatus partly broken away in section.

Referring to FIG. 1 of the drawings, a chemical canister 1 is provided at its upper end with an inlet opening 2 to which one end of an exhalation tube 3 is connected. The other end is connected to a conventional mouthpiece 4 or the like by means of a valve 5. The lower end of the canister has an outlet, such as a perforated bottom 6, that communicates with an inhalation tube 7 and also with an opening 8 into an expandable chamber, such as a breathing bag from This communication preferably is provided by mounting the canister in a housing 11, from the walls of which the canister is spaced. The space between the canister and housing is connected at the top by a conduit 12 to the bag opening. Also, it is desirable, but not absolutely necessary, to position another breathing bag 13 at the opposite side of the canister, with the bag opening likewise connected by a conduit 14 to the upper part of the canister housing. The canister is filled with a chemical 15, such as potassium superoxide, which will remove carbon dioxide and water vapor from the exhaled air flowing through the canister and will also liberate oxygen into that air. The liberated oxygen and the exhaled air inflate the expandable bags. During inhalation through breathing tube 7, air is withdrawn directly from the bags so that their volume decreases.

It is a feature of this invention that the air in the respirator system is maintained under positive pressure, meaning a pressure greater than atmospheric, so that if there is any leakage, it will be out of the respirator and not into it. A preferred way of accomplishing this is to make the bags in the general form of bellows, with rigid lower ends that engage coil springs 17 compressed between those ends and suitable supports. A preferred type of support is a casing 18 that encloses and protects the bags and the canister. The springs then can be compressed between the bottoms of the bags and the bottom of the casing.

During exhalation, as explained above, the exhaled air and liberated oxygen leaving the chemical canister will enter the breathing bags and expand them. However, such expansion is resisted by the coil springs which must be compressed by the bags in order for the bags to expand, so the user of the respirator must exhale with enough force to cause the bags to compress the springs. This will place the air in the respirator under positive pressure so that if there are any leaks in the apparatus or in the seal around the face, leaking of air will be out of the apparatus, not into it, thereby preventing inhalation of the ambient atmosphere. During inhalation, positive pressure in the respirator will be maintained because, as the user inhales and the bags start to collapse, the springs will expand and continue to exert pressure on them, thereby mantaining positive air pressure in the system. Preferably, the excess air pressure while the bags are relaxed is about 2 imbar.

The positive pressure in the system can be maintained when the respirator is set aside while not in use, if valve 5 is such that it can close off the inhalation and exhalation tubes when desired. Thus, the valve may include a closed end cylinder 20 that is rotatable in a cylindrical housing 21 by means of a projection 22 at the outer end of the valve cylinder. The cylinder and housing are provided with openings that normally register with the two tubes, but when the cylinder is turned 90° this communication with the tubes is shut off and no flow through the tubes can occur.

Although a circulatory breathing system has been illustrated, it will be understood that this invention also applies to rhythmical or pendulum breathing, in which a single breathing tube is used for both inhalation and exhalation and no valves are required. Also, instead of using springs to create a back pressure, the bags themselves can be made wholly or partly of elastic material that will have to stretch during exhalation, thereby resisting entrance of air into the bags.

Figure 2:
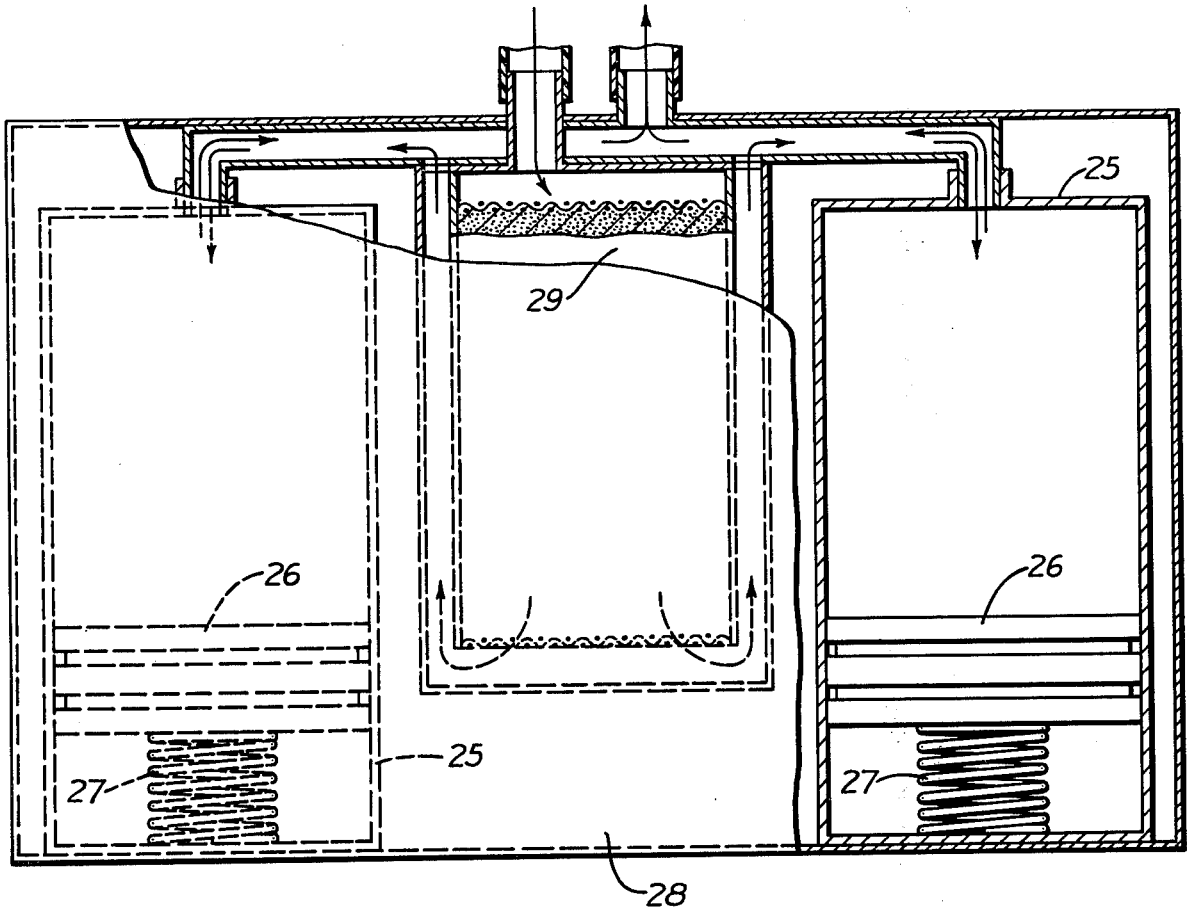
FIG. 2 is a similar fragmentary view of a modification.

As shown in the modification illustrated in FIG. 2, cylinders 25 are substituted for the breathing bags, and pistons 26 are disposed in their lower ends. The pistons rest on coil springs 27 supported by a casing 28 that also contains the chemical canister 29. During exhalation, the pressure created in the cylinders will force the pistons downwardly against the resistance of the springs, whereby the air in the respirator will be under positive pressure. The positive pressure will continue during inhalation because the springs will force the pistons upwardly in the cylinders to maintain the air in the system compressed.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A respirator comprising a mouthpiece, a casing provided in its top with an inlet opening and an outlet opening, an inhalation tube connecting said outlet opening with the mouthpiece, an exhalation tube connecting the mouthpiece with said inlet opening, a canister in said casing provided at one end with an inlet connected with said casing inlet opening, the canister having an outlet at its opposite end, a chemical in the canister between its inlet and outlet that removes water vapor and carbon dioxide from air flowing through it and liberates oxygen into that air, a housing containing the canister and spaced from its outlet end, the housing having a pair of outlets communicating with the canister outlet, a pair of expandable chambers in said casing with said housing between them, each chamber being provided with a single inlet-outlet port, conduits connecting said housing outlets with said ports and said casing outlet opening, and means in the casing resisting expansion of said chambers during exhalation through said canister, whereby to maintain the air in the respirator under positive pressure.

2. A respirator according to claim 1, in which said housing also is spaced from the side of said canister, said housing outlets are in the top of the housing at opposite sides of the canister, and said chamber ports are in the tops of said chambers.

* * * * *